US010559420B2

(12) United States Patent
Schrammel

(10) Patent No.: US 10,559,420 B2
(45) Date of Patent: Feb. 11, 2020

(54) TRANSFORMER AND METHOD FOR RETROFITTING A TRANSFORMER

(71) Applicant: SIEMENS AKTIENGESELLSCHAFT, Munich (DE)

(72) Inventor: Alfons-Karl Schrammel, Waldbach (AT)

(73) Assignee: Siemens Aktiengesellschaft, Munich (DE)

( * ) Notice: Subject to any disclaimer, the term of this patent is extended or adjusted under 35 U.S.C. 154(b) by 67 days.

(21) Appl. No.: 15/554,952

(22) PCT Filed: Feb. 8, 2016

(86) PCT No.: PCT/EP2016/052626
§ 371 (c)(1),
(2) Date: Aug. 31, 2017

(87) PCT Pub. No.: WO2016/139030
PCT Pub. Date: Sep. 9, 2016

(65) Prior Publication Data

US 2018/0033545 A1 Feb. 1, 2018

(30) Foreign Application Priority Data

Mar. 5, 2015 (EP) ..... 15157688

(51) Int. Cl.

| | |
|---|---|
| ***H01F 27/38*** | (2006.01) |
| ***H01F 27/10*** | (2006.01) |
| ***H01F 27/28*** | (2006.01) |
| ***H01F 27/29*** | (2006.01) |

(52) U.S. Cl.
CPC ..... *H01F 27/38* (2013.01); *H01F 27/10* (2013.01); *H01F 27/2823* (2013.01); *H01F 27/29* (2013.01)

(58) Field of Classification Search
CPC ..... H01F 27/38; H01F 27/10; H01F 27/2823; H01F 27/29
USPC ..... 336/220, 221, 222
See application file for complete search history.

(56) References Cited

U.S. PATENT DOCUMENTS

2017/0330682 A1* 11/2017 Hamberger ..... H01F 27/343

FOREIGN PATENT DOCUMENTS

| | | |
|---|---|---|
| CA | 2813057 | 4/2012 |
| CN | 101309011 | 11/2008 |
| CN | 101681716 | 3/2010 |
| CN | 102985838 | 3/2013 |
| WO | WO 2005/001857 | 1/2005 |
| WO | WO 2008/151661 | 12/2008 |

(Continued)

OTHER PUBLICATIONS

Office Action dated Jun. 4, 2018 which issued in the corresponding Canadian Patent Application No. 2,977,716.

(Continued)

*Primary Examiner* — Tszfung J Chan
(74) *Attorney, Agent, or Firm* — Cozen O'Connor

(57) ABSTRACT

A transformer having a magnetic core which includes at least one leg with a winding arrangement and a yoke, wherein a compensation winding arrangement is provided to compensate for a unidirectional flux fraction that flows in the at least one leg, and the compensation winding arrangement is arranged on the yoke.

5 Claims, 4 Drawing Sheets

(56) References Cited

FOREIGN PATENT DOCUMENTS

| | | | | |
|---|---|---|---|---|
| WO | WO-2008151661 | A1 * | 12/2008 | ..... H01F 27/34 |
| WO | WO 2011/127969 | | 10/2011 | |
| WO | WO-2011127969 | A1 * | 10/2011 | ..... G01R 33/0023 |
| WO | WO 2012/041368 | | 4/2012 | |
| WO | WO 2015/086048 | | 6/2015 | |

OTHER PUBLICATIONS

Office Action dated Jul. 30, 2018 issued in the corresponding Chinese Patent Application No. 201680013885.6.

* cited by examiner

TRANSFORMER AND METHOD FOR RETROFITTING A TRANSFORMER

CROSS-REFERENCE TO RELATED APPLICATIONS

This is a U.S. national stage of application No. PCT/EP2016/052626 filed 8 Feb. 2016. Priority is claimed on European Application No. 15157688.1 filed Mar. 5, 2015, the content of which is incorporated herein by reference in its entirety.

BACKGROUND OF THE INVENTION

1. Field of the Invention

The invention relates in general to the field of electrical transformers provided with a compensation device for compensating a unidirectional magnetic flux component.

2. Description of the Related Art

Electrical transformers of the type normally used in a power distribution system may be subject to an undesirable injection of direct current (hereinafter also referred to as a DC component) into the primary or secondary winding.

This DC component can be caused, for example, by power electronic circuits of the kind currently used for controlling electric drives or also for power factor correction in a power distribution system.

So-called "geomagnetically induced currents" (GIC) can also cause a unidirectional magnetic flux to develop in a transformer.

In both cases the operating behavior of the transformer can be affected, because a unidirectional magnetic flux is created that is superimposed on the alternating magnetic flux in the core of the transformer. This superimposition of unidirectional and alternating flux results in unbalanced saturation of the magnetic material and the attendant disadvantages thereof.

One the one hands local warding ("hot spots") may occur in the transformer core. This causes increased losses and may also adversely affect the useful life of the electrical winding. Another undesirable effect is increased noise emission. This occurs even in the case of a very small direct current of a few amperes. This is a particular disadvantage if the transformer is installed close to a residential area.

To reduce the noise emission of a transformer, it is proposed in DE 40 21 860 C2, for example, to provide a "compensation winding" on the core in addition to the usual winding arrangement. Injected into this compensation winding is a compensation current whose magnetic effect is directed so as to counteract or compensate the unidirectional magnetic flux in the transformer core.

In order to compensate a unidirectional flux component in the core of a transformer, a measuring device for measuring the unidirectional magnetic flux, a compensation winding and a thereto connected current control device is therefore required.

WO2011/127969 A1 discloses an exemplary measuring device for measuring a DC component.

WO2012/041368 A1 discloses an exemplary compensation winding connected to a current control device.

Usually, the compensation winding is already provided during manufacture of the transformer, where each limb of the transformer supports such a compensation winding in the region of the lower yoke, for example.

However, transformers are now valuable investment durables. Undesirable DC injection or GIC can also arise during the long service life of a transformer. However, it is almost prohibitively expensive to equip a transformer already in service with a unidirectional flux or DC compensation device. Such retrofitting or modification at least requires rebuilding of the existing winding arrangement, which is tantamount to replacing the transformer. At the same time, however, there is an overriding need for transformers already in service also to be provided with unidirectional flux compensation, as a DC component or GIC can occur at any time during operation.

SUMMARY OF THE INVENTION

In view of the foregoing, it is an object of the present invention is to provide a transformer such that the mounting of a compensation winding is as simple as possible, so that a transformer already in service can be fitted with a unidirectional flux compensation device.

A further object of the present invention is to provide a transformer retrofitting method that is as inexpensive as possible.

These and other objects and advantages are achieved in accordance with the invention by a transformer and by a method for retrofitting the transformer, where a compensation winding arrangement is provided that is not disposed on a winding-supporting limb of the transformer, as has hitherto usually been the case, but on the yoke of the transformer core. The compensation winding arrangement is electrically connected to at lease one assigned current control device for the purpose of compensating a DC component flowing in a limb of the transformer. The fact that the yoke supports the compensation winding arrangement ensures that the configuration of the primary or secondary winding, as well as the design of the transformer core, do not need to be modified. A number of advantages flow from this. Firstly, the main advantage is with respect to upgrading or retrofitting a transformer already in operation, as the compensation winding arrangement can be mounted at comparatively little cost. The transformer only needs to be disconnected from the grid for a short time in order to provide access to the upper yoke of the transformer. The transformer cover is opened and some of the insulating liquid and coolant is pumped out. As soon as the level of the insulating liquid and coolant has fallen below the level of the upper yoke, a compensation winding can easily be mounted manually on the upper yoke at one or more sections. The compensation winding is connected via a connecting cable to a current feeding device outside the tank. The insulating liquid and coolant is then pumped back up to the original level in the transformer tank. The transformer cover is closed and the transformer is then re-connected to the grid. The invention therefore makes it possible for a transformer already in operation (irrespective of the design of the transformer (e.g. single- or multi-limb core type)) which has become subject to injection of a DC component in the course of its operating life, or for transformers that are subject to GDC, to be equipped at comparatively low cost with a device for unidirectional flux compensation. Also, for these transformers already in operational service, this opens up the possibility of lowering losses, reducing heating, and curbing the noise emission thereof. The latter in particular is becoming an increasingly important factor.

The abovementioned advantages also extend to the manufacture of a transformer. In the manufacturing process, the inventive mounting of the compensation winding arrangement on the yoke also does not require the existing design of a transformer to be modified, neither with respect to the winding nor to the magnetic core. It is therefore possible to equip a transformer with unidirectional flux compensation at comparatively low costs even during the manufacturing process.

In short, it should be re-emphasized that the basic advantage of the invention comes from its use as part of a "retrofit solution". This is because it has hitherto been uneconomical for a transformer already in operation to be subsequently modified such that the unidirectional flux compensation would be possible.

In a preferred embodiment, the compensation winding arrangement is disposed on a section of the upper yoke. A compensation winding can be easily mounted on the upper yoke. A "retrofit solution" is a low-cost option.

For single- and multi-limb core transformers, an embodiment of the invention is preferably configured such that the compensation winding arrangement is formed from a plurality of winding loops each passing through a cooling gap between a clamping plate and an upper yoke section. This mounting space is generally present anyway as a cooling gap in high-power transformers. No design changes to a winding or insulation are necessary. The loops are wound directly around the yoke.

For transformers of 3-, 4-, and 5-limb core design, a preferred embodiment is configured such that at least two loops of the compensation winding arrangement are always wound around a section of the upper yoke between two main limbs. These again extend through the cooling gap, formed between the outer lamination of the yoke and the adjacently opposite clamping plate.

In a preferred embodiment, the compensation winding arrangement is constituted by at least two conductor loops. Each of these conductor loops extends along sections extending in the direction of the yoke. A first corresponding wire pair of these conductor sections is interconnected, e.g., by crimping. The second corresponding wire pair ends in terminal contacts. To the latter, an assigned current control device is connected via a connecting cable. As a result, an individually predefined compensation current can be injected for each main limb. This allows differentiated compensation of a unidirectional flux component $\Phi_{DC}$, suitably matched to the respective main limb.

In other advantageous embodiments of the invention, the compensation winding can be comprised of one or more turns, matched to the predefined voltage burden of the current control device used.

The abovementioned technical object is also achieved by a method for retrofitting a transformer, where the following steps are performed on a transformer already in operation:

a. Disconnect the transformer from a power distribution system;
b. Drain off at least some of the coolant and insulating liquid contained in the transformer tank;
c. Open the transformer tank so that sections of the yoke are accessible;
d. Mount a compensation winding arrangement on at least one section of the upper yoke;
e. Establish a connection between the compensation winding arrangement and a current control device disposed outside the transformer tank;
f. Close the transformer tank;
g. Top up the transformer tank with the amount of coolant and insulating liquid drained off in step b, and
h. Connect the transformer to the power distribution system.

This method provides a very inexpensive way to retrofit a transformer already in operation (including transformers of older design) with a compensation device. For this retrofitting, it is unnecessary to modify either the existing primary or secondary winding or the magnetic circuit. For mounting, the compensation winding is simply looped round sections of the upper yoke. Cooling system ducts already present can be advantageously used. The individual loops of the compensation winding are simply run between the yoke clamping plates and the yoke. As already stated, each winding can consist of one or more turns. The winding loops are then joined and connected to a current control device. This current control device is usually located outside the transformer tank. The advantages of the method in accordance with the disclosed embodiments of the invention basically correspond to the advantages as already described above with reference to the transformer in accordance with the disclosed embodiments of the invention. The assembly or retrofitting cost is low. The interruption in the power distribution system is short. The "retrofit solution" provides a comparatively low-cost way to modernize or upgrade an existing plant. Transformers are known to be designed for a long service life. If, for example, such a transformer that has been in operation for years becomes subject to increased noise emission due to direct current injection, then the transformer can be modernized with minor modifications and provided with the functionality of unidirectional flux compensation, making the transformer quieter in operation.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following section of the description to drawings illustrating further advantageous embodiments, details and further developments of the invention on the basis of non-limiting examples, in which.

DETAILED DESCRIPTION OF THE EXEMPLARY EMBODIMENTS

Figure 1:
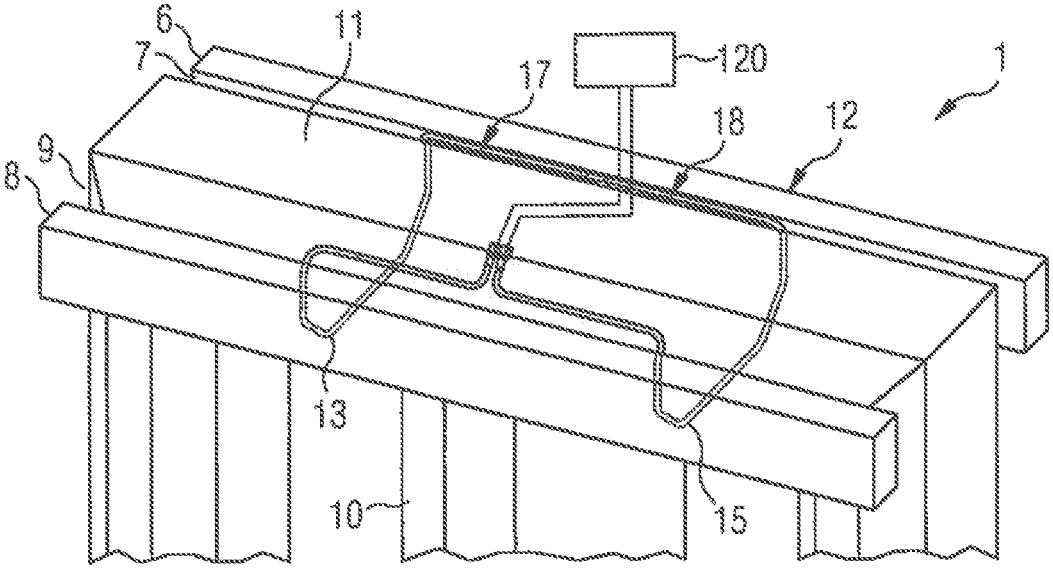
FIG. 1 shows a three-dimensional representation of a first embodiment of the invention having a compensation winding turn disposed on the upper yoke of a 1-limb sleeve core.

The following description explains various embodiments of the invention as illustrated in FIGS. 1-5, each showing a three-dimensional view of the upper section of a magnetic core of a particular design of transformer. Corresponding structural units are provided with the same reference characters.

In the following, the term conductor loop is to be understood as meaning in general an area to be spanned by a conductor, where the conductor loop is intended to represent an elementary form of a winding that can consist of a single turn or a plurality of turns. Each of the conductor structures designated hereinafter by the reference character 12 is therefore to be understood as being a single loop or a winding consisting of a plurality of turns.

FIG. 1 shows a perspective view of the upper region of the magnetic core of an electrical transformer 1 of 1-limb sleeve core design. The central limb 10 of the transformer 1 supports a winding arrangement (not shown in greater detail in FIG. 1), consisting of a primary and secondary winding, where the two limbs left and right of the limb 10 constitute the magnetic return path of this design. A yoke 11 connects the two return limbs and the central limb 10. FIG. 1 shows two yoke clamping plates 6, 8 by which the laminations of the core stack 11 are pressed together. A space or cooling gap 9 is formed between the front yoke clamping plate 8 and the yoke 11, and likewise a cooling gap 7 is formed between the rear yoke clamping plate 6 and the yoke 11. In FIG. 1, the compensation winding arrangement 12 is disposed on the yoke 11 in the region of the central limb 10. The compensation winding arrangement 12 basically consists of two conductor loops 13, 15. Each of these conductor loops 13, 15 is wound around a section of the upper yoke 11 formed between the limb 10 and the magnetic return path. After winding around this section, the two conductor loops 13, 15 are continued by conductor sections 17,18 extending in the longitudinal direction of the yoke 11. The two converging rear conductor sections 17, 18 lie in the gap 7. Their ends are crimped, together. The front two conductor sections 17, 18 run in the front gap 9. Their ends form contact terminals for a connecting cable leading to a current control device that is provided with the reference character 120 in FIG. 1. The current control device 120 is used to inject a compensation current whose magnetic effect in the transformer core will be explained in greater detail below in the description relating to FIG. 6. The compensation current is injected in accordance with a sensor that detects the direction and magnitude of the unwanted DC component. This sensor is not shown in the drawings.

Figure 2:
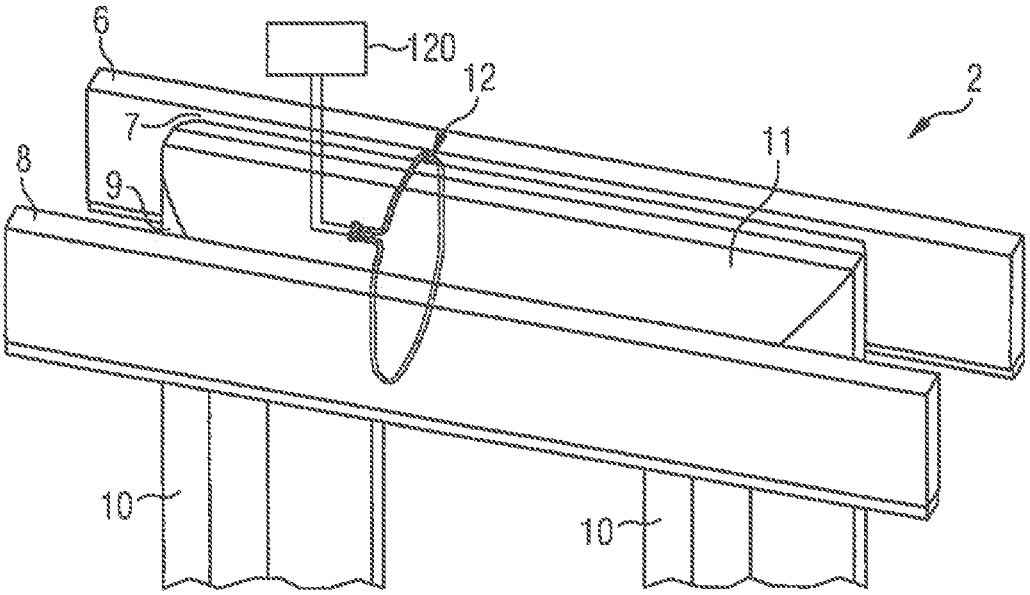
FIG. 2 shows a three-dimensional representation of a second embodiment of the invention having a compensation winding disposed on the upper yoke of 2-limb core.

FIG. 2 shows an exemplary embodiment of the invention based on a core for a 2-limb core transformer 2. The magnetic core consists of two limbs 10 that each support the transformer winding. The two limbs 10 are connected, by the yoke 11. FIG. 2 shows a compensation winding arrangement 12 inventively disposed on the upper yoke 11. The compensation winding arrangement 12 consists of a single conductor loop or a plurality of conductor turns. The compensation winding 12 is looped around the upper yoke 11, where it is looped such that the conductor again runs in the gap 7, the lower region of the upper yoke 11 and then up again in the gap 9. The two ends of the conductor loop 12 form terminal contacts. A connecting cable again extends from these terminal contacts to a current control device 120 for injecting a compensation current.

Figure 3:
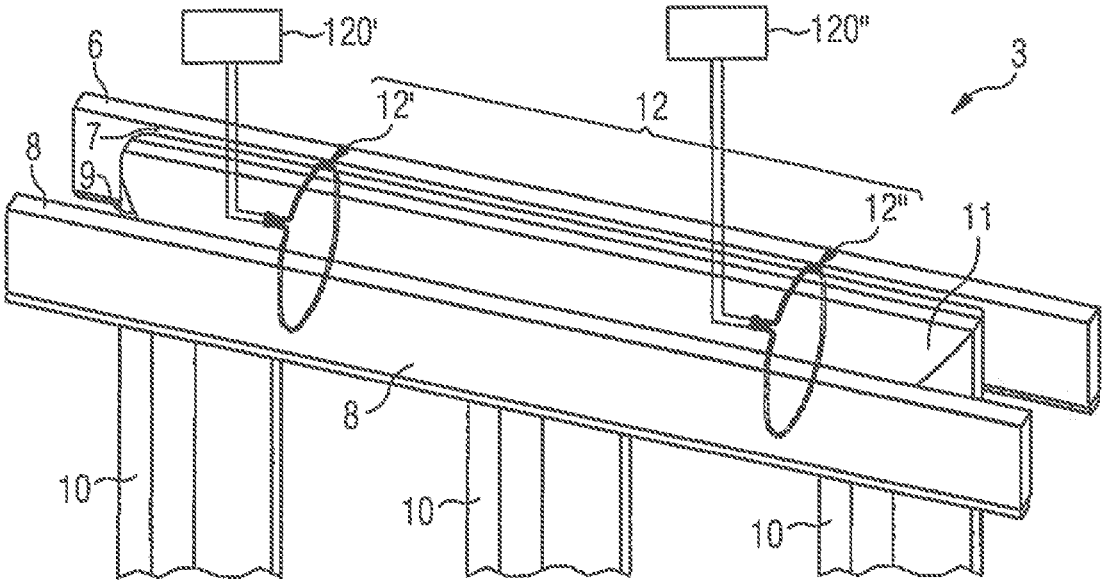
FIG. 3 shows a three-dimensional representation of a third embodiment of the invention having a compensation winding disposed on the upper yoke of a 3-limb core.

FIG. 3 shows a third embodiment of the invention using the example of an electrical transformer 3 of 3-limb core design. The 3-limb core consists of three winding-supporting limbs 10 and a connecting yoke 11. Once again the laminations of the yoke 11 are pressed together on both sides by yoke clamping plates 6, 8. The two yoke clamping plates 6 and 8 are disposed laterally at a spacing 7 and 9 respectively from the yoke 11. Here, the compensation winding arrangement 12 consists of two conductor loops 12', 12". In the illustration in FIG. 3, the left of the two conductor loops 12' is disposed on the upper yoke section 11 connecting the left limb 10 and the central limb 10, where the conductor loop 12" on the right-hand side in FIG. 3 is disposed on an upper yoke section 11 connecting the central limb 10 and the right limb 10. Viewed from the top terminal contacts of FIG. 3, the conductor extends into the gap 9 between the front yoke clamping plate 8 and the yoke 11, then loops around the lower section of the yoke 11 and passes up again into the gap between the rear yoke clamping plate 6 and the yoke 11 to terminal contacts. The terminal contacts of each conductor loop 12', 12" are again connected to a respective current control device 120', 120". As each compensation winding 12', 12" is controlled by a separate assigned current control device 120', 120", it is possible for a differentiated effect to be produced on a unidirectional flux component in the left- and right-hand limb 10, respectively. Each current control device 120', 120" operates autonomously. These two separate current control devices 120', 120" make it possible to compensate a unidirectional flux component in each limb 10 individually and independently of one another.

Figure 4:
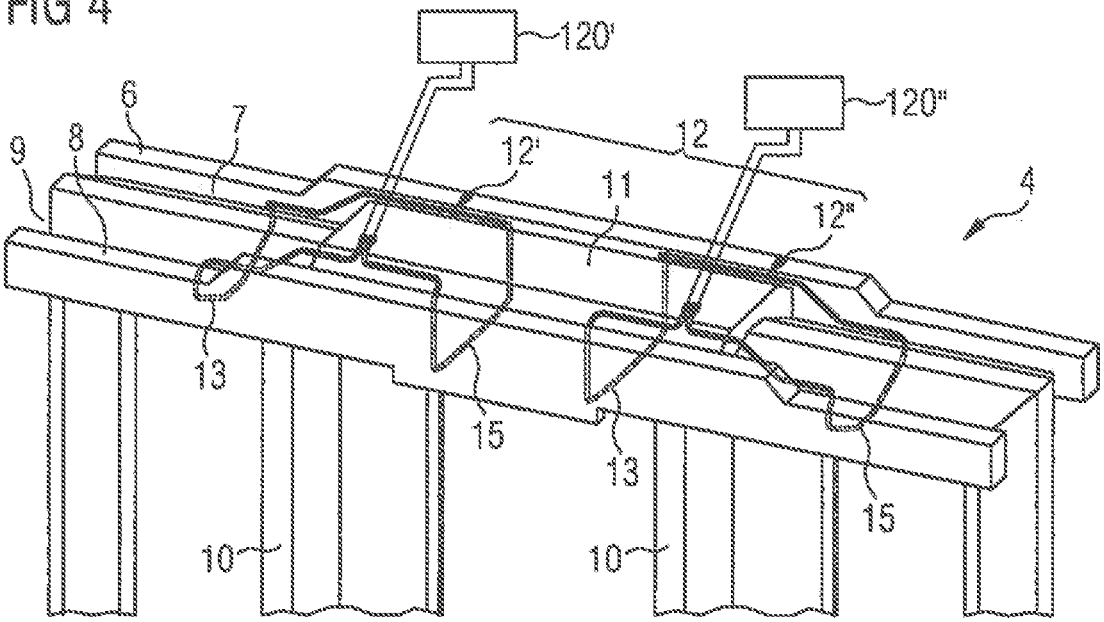
FIG. 4 shows a three-dimensional representation of a fourth embodiment of the invention having a compensation winding disposed on the upper yoke of a 4-limb core.

FIG. 4 shows a fourth exemplary embodiment of the invention. Once again the upper section of the magnetic core of a transformer is shown, using the example of a transformer 4 of 4-limb core design. In this 4-limb core, the two main limbs 10 each support a winding stack (not shown in FIG. 4). The magnetic return path is via return limbs left and right of the two limbs 10. As described in the examples above, the laminations of the yoke 11 are again pressed together by two yoke clamping plates 6, 8. Between a yoke clamping plate 6, 8 and the yoke 11 there is again a respective cooling gap 7, 9. The compensation winding arrangement 12 consists of a first compensation winding 12' and a second compensation winding 12". Each of these compensation windings 12', 12" is disposed on the upper yoke 11 at the head of a limb 10 in each case. Similarly to the compensation winding arrangement 12 explained in FIG. 1, each of these windings 12', 12" consists of two conductor loops 13 and 15 that extend along the yoke 11 (in a stepwise linear conductor sections in this example). The linear conductor sections are stepped in accordance with the available space in the gaps 7 and 9, respectively. These stepwise linear conductor sections of a winding 12', 12" again extend toward one another. The rear linear conductor sections extending in the gap 7 are again interconnected, and the front linear conductor sections extending in the gap 9 once again end in contact pairs for connecting an assigned current control device 120' and 120". Each of these two current control devices 120' and 120" impresses a compensation current in the thereto assigned winding 12" and 12" respectively, so that a unidirectional flux component present in one of the two limbs 10 can be compensated. The respective compensation current is again predefined in accordance with a sensor that detects the respective unidirectional flux $\Phi_{DC}$ to be compensated. This separate injection in the two windings 12', 12" makes it possible to compensate in a differentiated manner, even in the case of the 4-limb core design shown, and to counteract the unidirectional flux $\Phi_{DC}$ flowing in a limb 10 depending on the direction and magnitude thereof.

Figure 5:
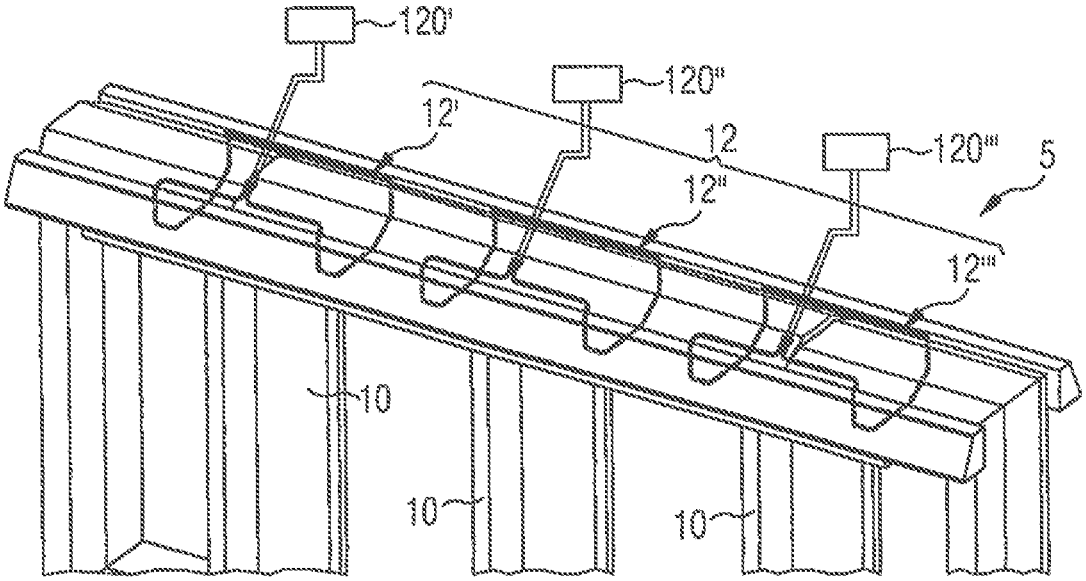
FIG. 5 shows a three-dimensional representation fifth embodiment of the invention having a compensation winding disposed on the upper yoke of a 5-limb core.

FIG. 5 shows a fifth exemplary embodiment of the invention based on a transformer of a 5-limb core construction. This 5-limb core 5 consists of three main limbs 10 that each support a winding arrangement, and two outer return limbs. A yoke 11 again connects these three limbs 10 and the two return limbs. In this embodiment, the compensation winding arrangement 12 consists of three separate windings 12', 12" and 12'" which are again disposed on the upper yoke 11 and are supplied by three separate current sources 120', 120" and 120'". Here, the separate predefining of the compensation current in each of the windings 12', 12" and 12'" also allows a differentiated effect to be produced for compensating an unwanted unidirectional flux component $\Phi_{DC}$ in the three limbs 10.

In the above-described five exemplary embodiments, the tank bushing for the connecting cable that connects the compensation winding to the current control device disposed outside the tank is disposed on the low-voltage side of the transformer for reasons of space.

Figure 6:
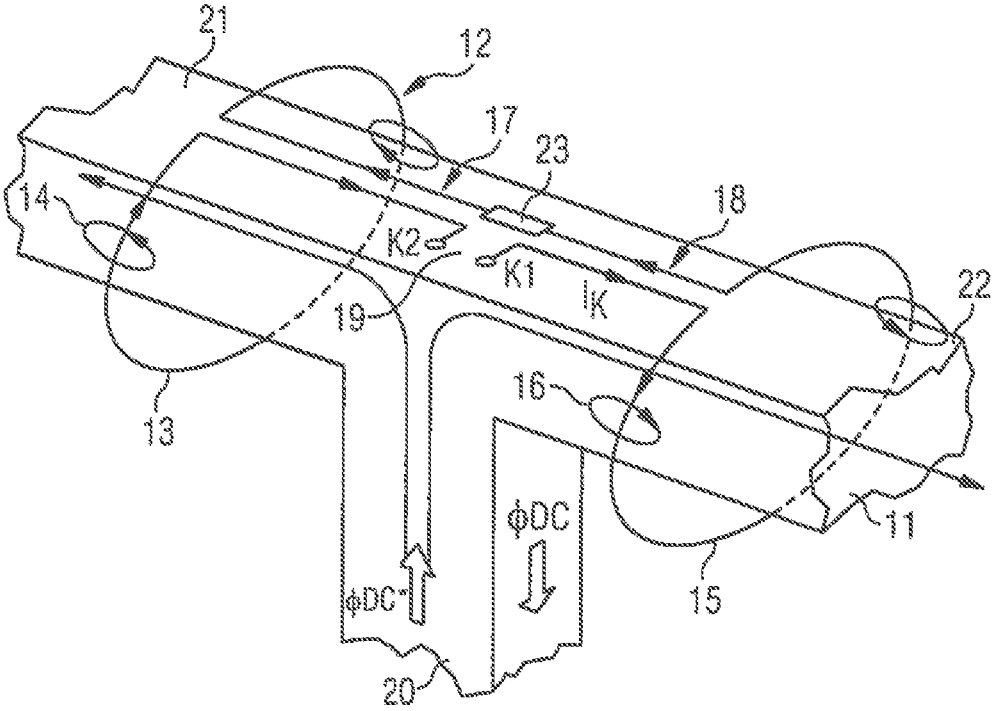
FIG. 6 schematically illustrates a compensation winding disposed on an upper yoke, showing the compensation of a unidirectional flux component in the limb in accordance with the invention.

Finally, the operating principle for the exemplary embodiments illustrated in FIG. 1, FIG. 4 and FIG. 5 will be explained in greater detail with reference to the three-dimensional sketch in FIG. 6. FIG. 6 shows this embodiment of the compensation winding arrangement 12 in the region of the connection between upper yoke 11 and limb 20. An unwanted unidirectional flux $\Phi_{DC}$ is flowing in the limb 20. This magnetic unidirectional flux $\Phi_{DC}$ is superimposed on the alternating flux, so that the magnetic material is saturated to different degrees in both half cycles. This results in increased losses and exacerbates noise emission. The purpose of the compensation winding arrangement 12 is to compensate this unidirectional flux $\Phi_{DC}$. The compensation winding arrangement 12 basically consists of two open conductor loops 13, 15 that are bent around the yoke and extend in pairs with conductor sections 17 and 18 respectively in the direction of the yoke. The conductor loops 13, 15 are each bent around an area running approximately at right angles to the direction of the magnetic flux in the yoke 11. As shown in FIG. 6, the first conductor loop 13 is wound around a yoke section 21 to the left of the limb 20, and the second conductor loop 15 around a yoke section 22 to the right of the limb 20. After the looping, the conductor loop 13 continues with the wire pair 17 and the conductor loop 15 with the wire pair 17 in the direction of the yoke, where the ends of the sections 17 and 18 are aligned to one another. The two rear conductor sections 17 and 18 are interconnected at a connection point 23. The two front conductor sections 17 and 18 end in two terminal contacts K1 and K2, respectively. A compensation current $I_K$ is injected via these terminal contacts K1, K2. In FIG. 6, this compensation current $I_K$ flows in via the terminal K1 and out of the compensation winding arrangement 12 via the terminal K2. Depending on the thus predefined current direction, the magnetic field strength interlinked with the current flow in the conductor loop IS has a direction according to the arrow 16 (a right-hand helix viewed in the current direction), i.e., in the conductor loop 13 a direction according to the arrow 14. In accordance with the continuity law, a magnetic compensation flux $\Phi_{DC}$* is formed in the limb 20. This magnetic compensation flux $\Phi_{DC}$* goes from the bottom up in FIG. 6, i.e., counteracts the unidirectional flux component $\Phi_{DC}$ to be compensated. By knowing the magnitude and direction of the unidirectional flux $\Phi_{DC}$ it is basically possible to reduce, i.e., compensate, the unwanted effect thereof. This has the effect of enabling "hot spots" and increased noise emission to be at least substantially reduced.

As already mentioned above, a compensation winding 12, 12', 12", 12'" can consist of a plurality of turns in each case. In practice, the number of turns depends on the voltage category of the transformer, because the compensation control device 120', 120", 120'" has to withstand the voltage induced in a respective compensation winding 12', 12", 12'". In a practical example, for an induced voltage of 300 V, the compensation winding arrangement 12 consists of two turns.

Figure 7:
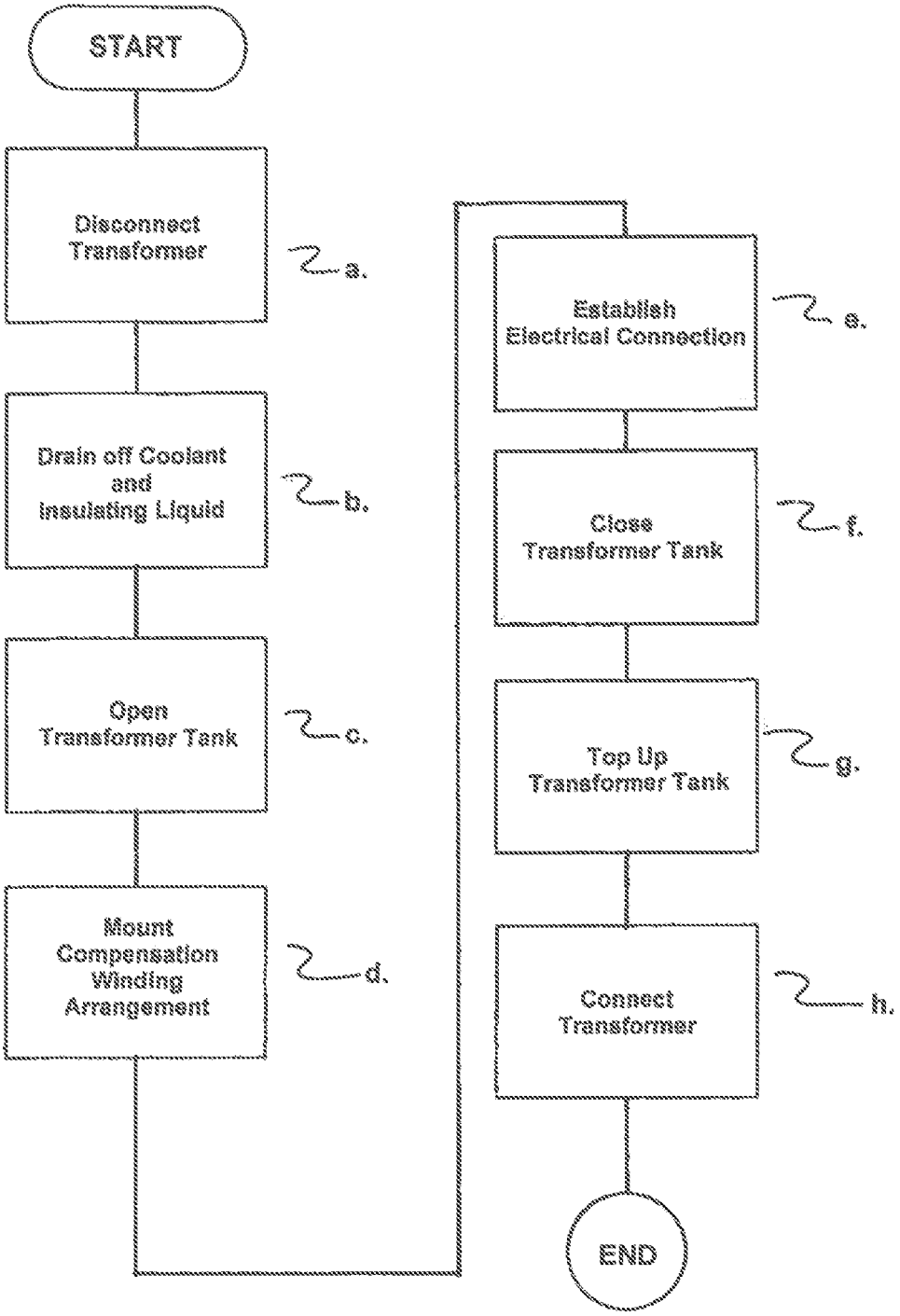
FIG. 7 is a flowchart of the method in accordance with the invention.

FIG. 7 is a flowchart of the a method for retrofitting a transformer incorporated in a power distribution system and having a core comprising at least one limb 10 with a winding arrangement and a yoke 11, where the core is disposed in a transformer tank which is filled with a coolant and insulating liquid.

The method comprises disconnecting the transformer from the power distribution system, as indicated in step a. Next, at least some of the coolant and insulating liquid is drained off, as indicted in step b.

Next, the transformer tank is opened so that sections of the yoke 11 are accessible, as indicated in step c.

A compensation winding arrangement 12 is now mounted on at least one section of the yoke 11, as indicated in step d.

Next, an electrical connection is established between, the mounted compensation winding arrangement 12 and at least one current control device 120, 120', 120", 120'" disposed outside the transformer tank, as indicated in step a.

Now the transformer tank is closed, as indicated in step f. Next, the transformer tank is topped up with the quantity of the coolant and insulating fluid drained off in step b, as indicated in step g.

Next, the transformer is connected to the power distribution system, as indicated in step h.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A transformer comprising:

a magnetic core including at least one limb having a winding arrangement and a yoke;

a compensation winding arrangement disposed on the yoke, said compensation winding arrangement compensating for a unidirectional flux component flowing in the at least one limb;

wherein the compensation winding arrangement includes at least one compensation winding which is formed from a plurality of conductor loops;

wherein each conductor loop of the plurality of conductor loops includes a plurality of wire sections extending in a direction of the yoke and oriented toward one another; and wherein a first corresponding wire pair is interconnected and a second corresponding wire pair is extended to terminal contacts which are provided for a connection to an assigned current control device.

2. The transformer as claimed in claim 1, wherein the compensation winding arrangement is disposed on a section of an upper yoke.

3. The transformer as claimed in claim 2, wherein the compensation winding arrangement is formed from at least one open conductor loop which is wound at least partly around a section of the upper yoke.

4. The transformer as claimed in claim 3, wherein the compensation winding is formed from a plurality of turns.

5. The transformer as claimed in claim 3, wherein the compensation winding arrangement is formed from one of (i) a plurality of compensation windings and (ii) three compensation windings to which a respective separate current control device is assigned.

* * * * *